US005144902A

United States Patent [19]

Hirabayashi

[11] Patent Number: 5,144,902

[45] Date of Patent: Sep. 8, 1992

[54] THREAD TRIMMER FOR A PATTERN SEWING MACHINE

[75] Inventor: Shintaro Hirabayashi, Nagoya, Japan

[73] Assignee: Brother Kogyo Kabishiki Kaisha, Nagoya, Japan

[21] Appl. No.: 755,177

[22] Filed: Sep. 5, 1991

[30] Foreign Application Priority Data

Sep. 6, 1990 [JP] Japan ..... 2-237998

[51] Int. Cl.[5] ..... D05B 65/02; D05B 3/02

[52] U.S. Cl. ..... 112/292; 112/300; 112/445; 112/453

[58] Field of Search ..... 112/292, 300, 291, 285, 112/293, 294, 295, 296, 297, 298, 445, 453, 103, 121.12, 454

[56] References Cited

U.S. PATENT DOCUMENTS 4,080,914 3/1978 Ishida et al. ..... 112/300 X
4,870,916 10/1989 Kozawa et al. ..... 112/445 X
5,042,408 8/1991 Suzuki et al. ..... 112/292

*Primary Examiner*—Peter Nerbun
*Attorney, Agent, or Firm*—Oliff & Berridge

[57] ABSTRACT

A thread trimmer for a pattern sewing machine is disclosed. When the pattern sewing machine forms patterns, a pattern is connected to a next pattern by a crossover thread. The thread trimmer automatically cuts a specified portion of the crossover thread. Therefore, the operator can avoid the troublesome and time-consuming cutting of the crossover thread manually with scissors. Furthermore, the sewing efficiency of the pattern sewing machine is enhanced.

16 Claims, 4 Drawing Sheets

THREAD TRIMMER FOR A PATTERN SEWING MACHINE

BACKGROUND OF THE INVENTION

This invention relates to a thread trimmer provided in a pattern sewing machine for forming various patterns according to pattern data. The thread trimmer automatically cuts the specified portion of a crossover thread connecting a pattern and a next pattern to be formed.

In a known pattern sewing machine various patterns are formed according to various pattern data stored beforehand in a memory. The pattern sewing machine is provided with a thread trimmer comprising a fixed knife and a movable knife. At a desired time after a series of sewing operations, the thread trimmer trims needle thread and bobbin thread.

While the pattern sewing machine forms patterns on the fabric, a pattern is connected via a crossover thread to the next pattern to be formed. As shown in FIGS. 3A and 3B, when characters A and B are formed on the fabric, a stitch connecting the end a of the character A and the beginning b of the character B corresponds to the crossover thread. When the characters A and B are distant from each other, as shown in FIG. 3B, a needle bar is disconnected and no stitches are formed between the characters A and B. The needle thread connecting the end a of the character A and the beginning b of the character B also corresponds to the crossover thread. The crossover thread is formed during the operation of the pattern sewing machine. After the operation is completed, the crossover thread is no longer needed, so an operator cuts the crossover thread with scissors. The cutting of the crossover thread is both troublesome and time consuming.

SUMMARY OF THE INVENTION

An object of this invention is to provide a thread trimmer for a pattern sewing machine, that can automatically cut the specified portion of the crossover thread connecting a pattern and the next pattern to be formed by the pattern sewing machine.

To attain this and other objects, the present invention provides a pattern sewing machine which comprises a needle bar carrying a needle at a lower end and being moved vertically by an arm shaft driven by a sewing machine motor, a memory means storing a pattern data indicative of a pattern, and a phase detection means for detecting a rotary phase of the arm shaft and for sending out a timing signal indicative of lowering of the needle bar. The pattern sewing machine further comprises a thread trimming means for trimming a needle thread and a bobbin thread after stitches are formed on a fabric according to a relative movement of the needle and the fabric, and a trimming designation means for specifying a cut portion of a crossover thread between the respective pattern and a next pattern to be formed according to the pattern data stored in the memory means. The pattern sewing machine also comprises a trimming memory means for storing a trimming signal indicative of the cut portion of the crossover thread specified by the trimming designation means, and a trimmer drive means for driving the thread trimming means in response to both the trimming signal and the timing signal.

DETAILED DESCRIPTION OF THE PREFERRED EMBODIMENT

Figure 2:
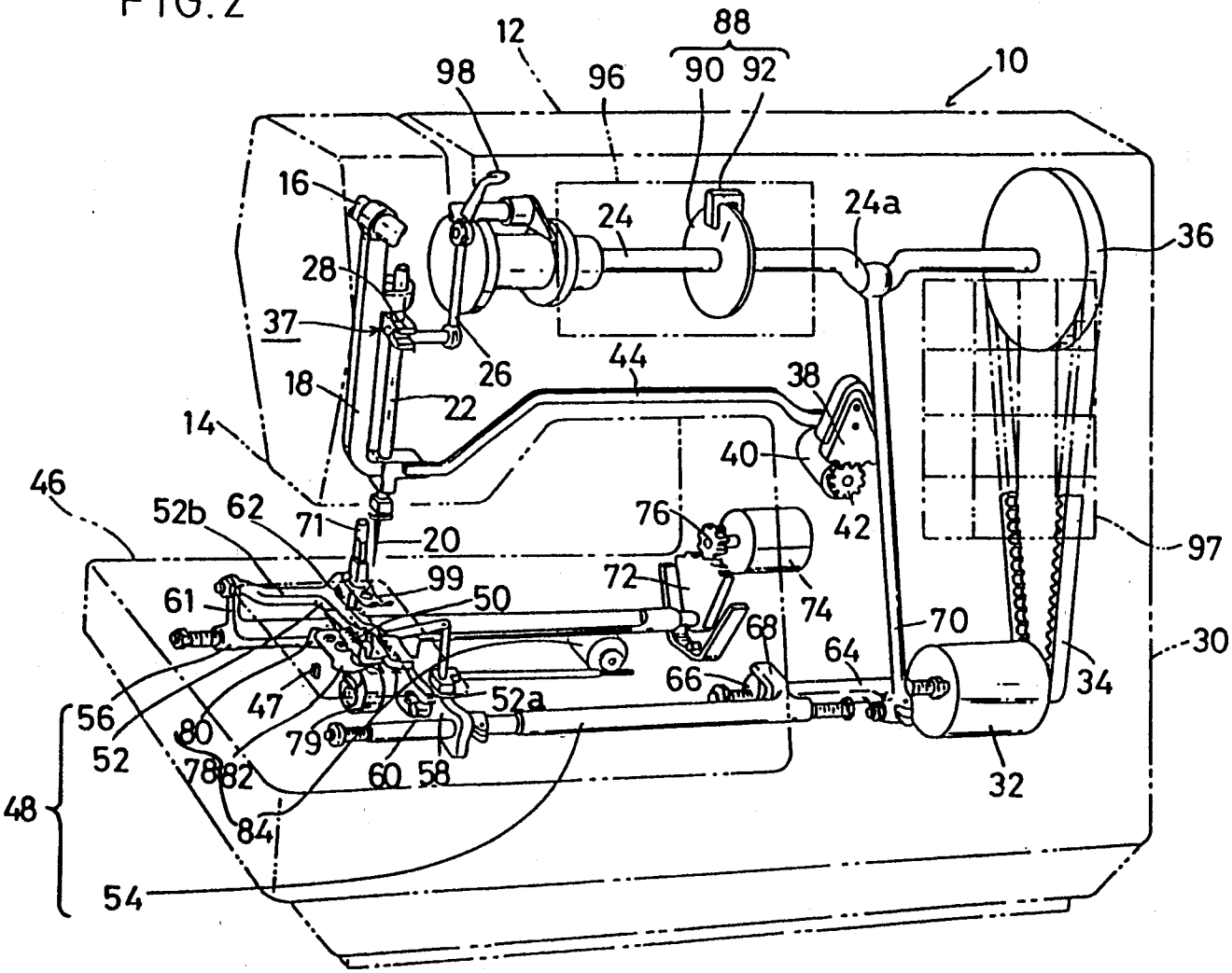
FIG. 2 is a schematic view of the pattern sewing machine.

As shown in FIG. 2, in an electronically controlled pattern sewing machine 10, a support 18 hangs from a pin 16 in a head 14 at the left end of an arm 12, as the figure is viewed, such that the support 18 can rotate by a predetermined angle. The support 18 supports a needle bar 22 carrying a needle 20 at its lower end, such that the needle bar 22 is vertically movable. In the arm 12, an arm shaft 24 is horizontally provided. A connecting rod 26 is connected from the arm shaft 24 via a needle bar connecting stud 28 to the needle bar 22. In a bed leg 30 a sewing machine motor 32 is provided. The drive power of the sewing machine motor 32 is transmitted through a belt 34, a pulley 36 and the arm shaft 24 to the connecting rod 26, thereby moving the arm shaft 24 rotatably and the needle bar 22 vertically.

In the bed leg 30, a sector gear 38 rotatably meshes with a pinion 42 of a stepping motor 40 for rocking the needle bar 22. As shown in FIG. 2, the sector gear 38 is connected through a connector 44 to the support 18. By rotating the stepping motor 40 forward and backwards, the sector gear 38 rotates by a bounded angle. The rotation of the sector gear 38 is transmitted via the connector 44, thereby rocking the support 18 and the needle bar 22.

An arm bed 46 houses a feeding mechanism 48. The feeding mechanism 48 operates almost synchronously with the needle bar 22. A feed dog 50 is connected to the feeding mechanism 48, for feeding not-shown fabric vertically and back and forth. The feeding mechanism 48 includes a feed bar assembly 52 for supporting the feed dog 50, a feed lifting rock shaft 54 for moving the feed bar assembly 52 vertically, and a feed rock shaft 56 for moving the feed bar assembly 52 back and forth. A fork **52*a* and a T portion 52*b* are formed at the front and back end of the feed bar assembly 52, respectively. The feed lifting rock shaft 54 is pivotably supported at the side of the operator in the arm bed 46. A feed lifting crank 58 perpendicularly extends from the feed lifting rock shaft 54 and connects via a stud 60 to the fork 52*a*. The feed rock shaft 56 is supported in the back of the arm bed 46 such that the feed rock shaft 56 can rock around an axis. Rods 61 and 62 extend perpendicularly from the feed rock shaft 56. The T portion 52*b* of the feed bar assembly 52 is pivotably attached to the rods 61 and 62**.

A rocking shaft 64 is rotatably provided at the back of the feed lifting rock shaft 54. A cam 66 is secured to the rocking shaft 64 and is engaged with a forked rod 68 extending perpendicularly from the feed lifting rock shaft 54. The rocking shaft 64 is connected via a rod 70 to a connecting rod **24*a* formed onto the arm shaft 24. When the sewing machine motor 32** is driven, the arm shaft 24 rotates, thereby moving the needle bar 22 vertically. The drive power of the sewing machine motor 32 is transmitted via the arm shaft 24 to the rod 70, thereby rotating the rocking shaft 64. The drive power is transmitted from the rocking shaft 64 through the cam 66, the forked rod 68, the feed lifting rock shaft 54 and the feed bar assembly 52, thereby moving the feed dog 50 vertically.

A sector gear 72 is secured to the right end of the feed rock shaft 56 as the figure is viewed. The sector gear 72 meshes with a pinion 76 of a stepping motor 74 in the bed leg 30. When the stepping motor 74 is driven synchronously with the vertical movement of the feed dog 50, the feed dog 50 moves back and forth in the raised or lowered position of the feed dog 50.

In the arm bed 46 a thread trimmer 78 is provided in the area where the needle 20 lowers. The thread trimmer 78 trims needle thread and bobbin thread according to a predetermined command. The thread trimmer 78 is composed of a fixed knife 80 provided in the vicinity of a not-shown rotary hook assembly, a movable knife 82 for slidably engaging the fixed knife 80, and a trimmer stepping motor 84 for driving the movable knife 82. In the specified range of the rotary phase of the arm shaft 24, the movable knife 82 cooperates with the fixed knife 80 and trims the needle thread and the bobbin thread.

As shown in FIG. 2, a phase detector 88 is provided onto the arm shaft 24, for detecting the rotary phase of the arm shaft 24 and the current position of the vertically moving needle bar 22. The phase detector 88 detects whether the needle bar 22 is in an elevated position or in a lowered position. The phase detector 88 is comprised of a disc 90 having a radial slit and a photo interrupter 92 for holding therein the disc 90. When the rotary phase of the disc 90 and the arm shaft 24 is about 360 degrees, the photo interrupter 92 detects that the light beam passes through the slit in the disc 90, and sends a timing signal to a CPU 94 shown in FIG. 1. The timing signal corresponds to the current position of the needle bar 22.

A liquid crystal display 96 is provided at the side of the operator on the arm 12. The liquid crystal display 96 shows the pattern selected by the operator. A pattern input unit 97 composing a key panel is provided onto the bed leg 30. The operator can register the selected pattern with the pattern input unit 97. The drive mechanism for a needle thread take-up 98 and the mechanism for connecting a presser foot assembly 99 are well known for those skilled in the art and are omitted from the drawing and the description for simplicity.

Figure 1:
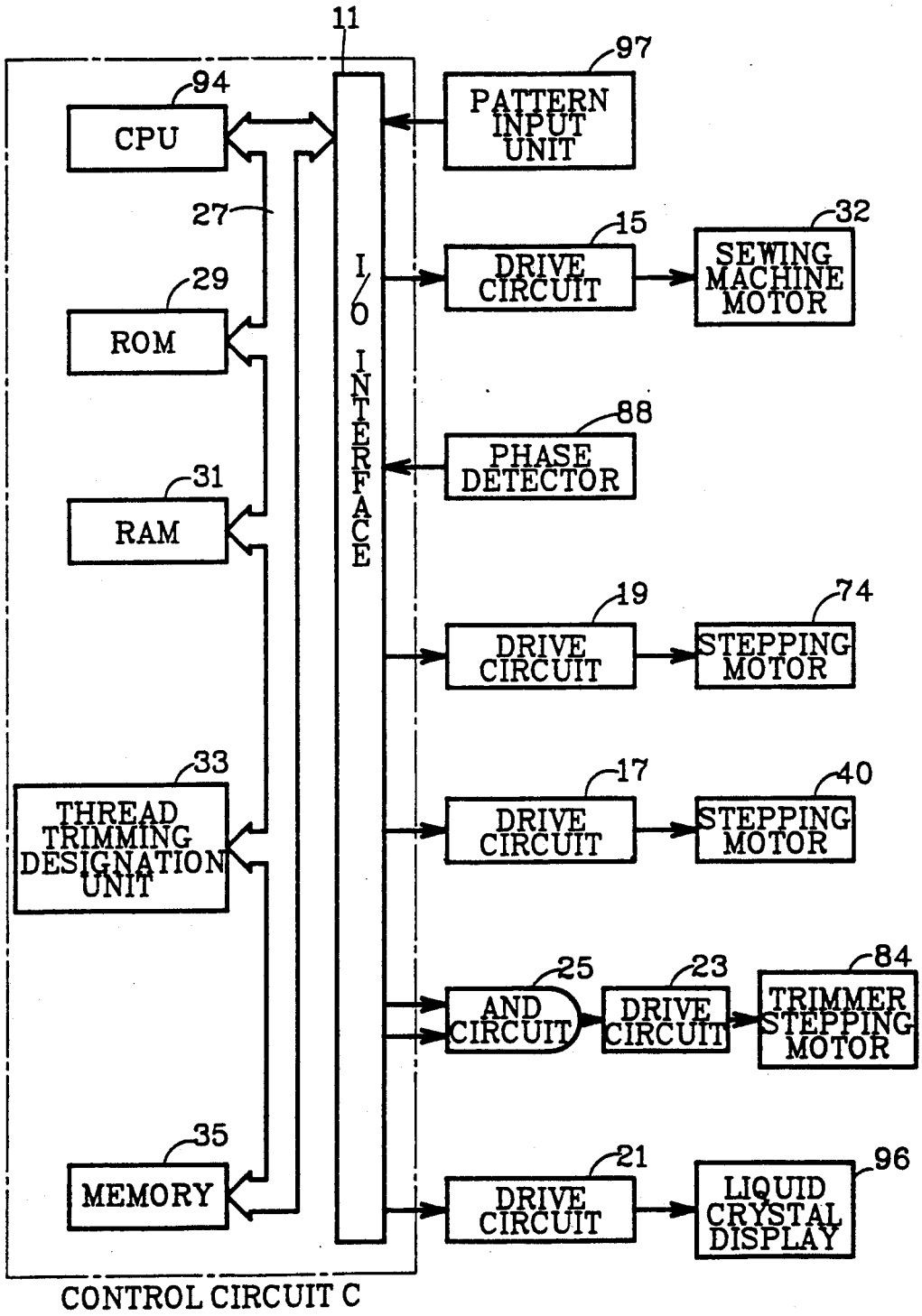
FIG. 1 is a block diagram of a control circuit for a pattern sewing machine embodying this invention.

The control system of the pattern sewing machine 10 will now be explained referring to the block diagram in FIG. 1. The pattern input unit 97 and the phase detector 88 are connected directly to an I/O interface 11 in a control circuit C. The phase detector 88 determines the timing of feeding the fabric. The sewing machine motor 32, the stepping motor 74, the stepping motor 40 and the liquid crystal display 96 are connected via drive circuit 15, 19, 17 and 21, respectively, to the I/O interface 11.

The trimmer stepping motor 84 is connected via a drive circuit 23 and an AND circuit 25 to the I/O interface 11. The AND circuit 25 sends a drive signal to the drive circuit 23 when the thread trimming signal sent from a memory 35 (described hereinafter) is logically ANDed with the signal indicative of the lowering of the needle bar 22 sent from the phase detector 88. The memory 35 stores the portion of the crossover thread to be cut. When the drive circuit 23 receives the thread trimming signal and the signal indicative of the lowering of the needle bar 22, the trimmer stepping motor 84 is driven. The needle thread and the bobbin thread are cut between the movable knife 82 and the fixed knife 80 of the thread trimmer 78.

Other elements (not shown) for operating the pattern sewing machine 10 are also connected via the I/O interface 11 for example a start/stop switch for selectively starting or stopping the operation of the pattern sewing machine 10, a speed detector for detecting the rotary speed of the arm shaft 24, a volume adjustment for adjusting the rocking amount of the needle bar 22, a volume adjustment for adjusting the feed amount of fabric, and a clock pulse generator for synchronizing the operation of movable components.

The CPU 94, a ROM 29 and a RAM 31 are connected via a bus 27 to the I/O interface 11. The ROM 29 stores the pattern data involving the needle location data for sewing various characters, symbols and other patterns. The needle location data includes the feed amount data and the needle rock data. The ROM 29 also stores the control program for reading the selected stitch pattern data and controlling the stepping motor 74 based on the feed amount data in response to the feed start signal. The ROM 29 further stores the control program for controlling the sewing machine motor 32 and the control program for determining the feed start timing based on the feed amount data and the speed signal. The RAM 31 includes memory for temporarily storing the results of the computation by the CPU 94.

The I/O interface 11 is connected via the bus 27 to a thread trimming designation unit 33 and the memory 35. The thread trimming designation unit 33 specifies the cut portion of the crossover thread between the previous and next patterns, before the next pattern is formed according to the stitch pattern data stored in the CPU 94. The thread trimming designation unit 33 reads the thread trimming code included in the stitch pattern data from the CPU 94 and determines which stitch corresponds to the end of a specified pattern and to the cut portion. The memory 35 stores the portion to be cut of the crossover thread specified by the thread trimming designation unit 33. The information regarding the portion to be cut of the crossover thread could be temporarily stored in the RAM 31, if memory is available.

Figure 3A:
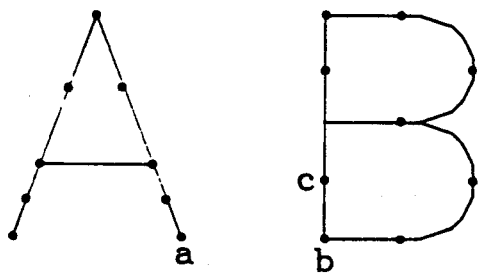
FIGS. 3A and 3B are schematic views of character patterns formed by the pattern sewing machine.
Figure 3B:
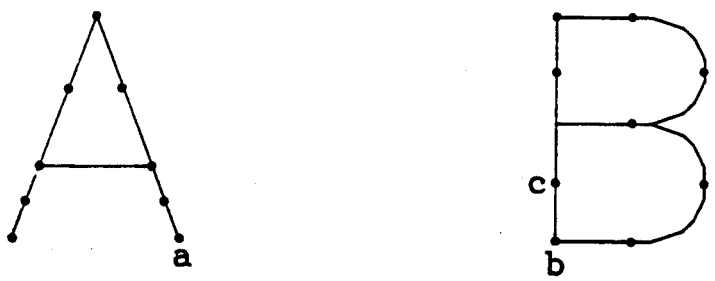

The operation of the thread trimmer 78 of the pattern sewing machine 10 will now be explained. The threading of the eye in the needle 20 precedes the operation of the pattern sewing machine 10. The pattern to be formed is input using the pattern input unit 97, and the input and selected pattern is shown on the liquid crystal display 96. Subsequently, a start/stop switch (not shown) is pressed, sending the start signal to the CPU 94. According to the control program stored in the ROM 29 the sewing machine motor 32 is driven via the drive circuit 15, thus rotating the arm shaft 24. According to the feed amount data for each sewing operation stored in the ROM 29, the stepping motor 74 is driven via the drive circuit 19, thus moving the feed dog 50 vertically and back and forth. According to the needle rock data for each sewing operation stored in the ROM 29, the stepping motor 40 is driven via the drive circuit 17, thus oscillating the needle bar 22 in a direction perpendicular to a cloth feeding direction. Such controlled vertical and horizontal movement of the needle bar 22 and the needle 20 as well as the vertical and reciprocating movement of the feed dog 50, forms stitches successively on the fabric (not shown) according to the stitch pattern data. When the stitches are formed into patterns, as shown in FIGS. 3A and 3B, the crossover thread connects the end of the pattern and the beginning of the next pattern. In this embodiment since the thread trimming designation unit 33 specifies the cut portion of the crossover thread and the memory 35 stores the cut portion of the crossover thread, the crossover thread is automatically cut.

Specifically, as shown in FIG. 3A, when the characters A and B are formed, the thread trimming designation unit 33 specifies that the portion between the end a of the character A and the beginning b of the character B is cut. The portion to be cut is stored in the memory 35. In operation, when the needle 20 lowers into the end a of the character A, as shown in FIG. 1, the memory 35 sends a thread trimming signal to one terminal of the AND circuit 25 connected to the drive circuit 23. The thread trimmer 78 operates when the needle 20 lowers into the fabric and the needle thread as well as the bobbin thread come between the movable knife 82 and the fixed knife 80 of the thread trimmer 78. Therefore, the other terminal of the AND circuit 25 receives the timing signal from the phase detector 88 which indicates that the needle bar 22 is in its lowered position. The AND circuit 25 sends a drive signal to the drive circuit 23 on the condition that the AND circuit 25 receives the thread trimming signal from the memory 35 and the timing signal from the phase detector 88. The drive circuit 23 drives the trimmer stepping motor 84, thereby operating the movable knife 82 of the thread trimmer 78. The needle thread as well as the bobbin thread are thus cut at the end a as shown in FIG. 3A.

Similarly, when the needle lowers into the beginning b of the character B, the memory 35 sends the thread trimming signal to one terminal of the AND circuit 25. The AND circuit 25 sends the drive signal to the drive circuit 23 on the condition that the AND circuit 25 receives the thread trimming signal from the memory 35 and the timing signal from the phase detector 88. The drive circuit 23 drives the trimmer stepping motor 84 to operate the thread trimmer 78. The needle thread as well as the bobbin thread are thus cut at the beginning b.

As shown in FIG. 3B, when the characters A and B are distant from each other and the needle bar 22 is disconnected, the characters A and B are connected by the needle thread and the bobbin thread without any stitch being formed.

Figure 4B:
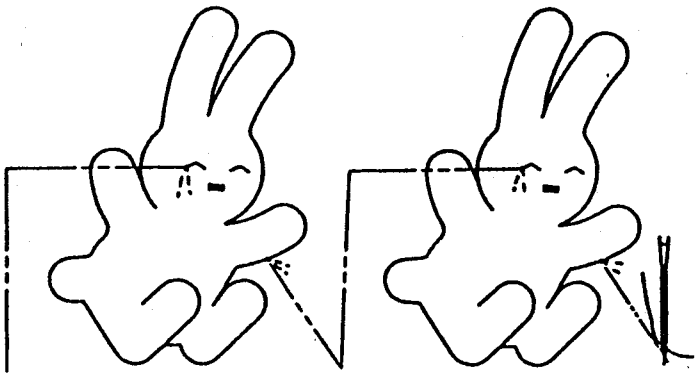
FIG. 4B shows the actual formation of the series of patterns displayed on the liquid crystal display shown in FIG. 4A.
Figure 4A:
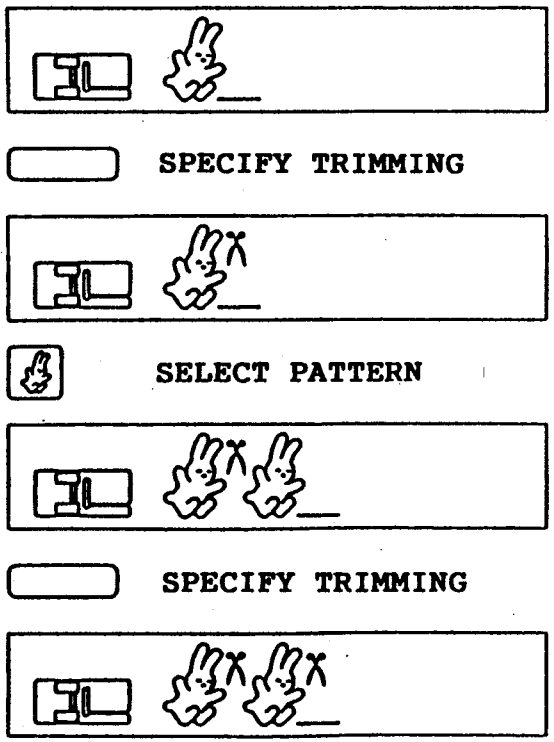
FIG. 4A is an illustration of a series of patterns to be formed and scissors symbols on a liquid crystal display.

When the thread trimming designation unit 33 specifies the portion to be cut of the crossover thread, the symbol of scissors is shown on the liquid crystal display 96 as shown in FIG. 4A. By blinking the symbol, the portion to be cut of the crossover thread could be indicated. The operator can visually confirm the portion to be cut of the crossover thread with the liquid crystal display 96 as shown in FIG. 4A. The series of patterns displayed as shown in FIG. 4A is actually formed as shown in FIG. 4B.

In this embodiment, the operator manually sets the portion to be cut into the thread trimming designation unit 33. The portion to be cut can be automatically determined according to input patterns. By including a trimming flag into the pattern data beforehand as shown in Table 1, any necessary trimming can be carried out automatically.

TABLE 1

| PATTERN | TRIMMING FLAG |
|---|---|
| UNDERLINED ALPHABETICAL WORDS | 0 (NO TRIMMING) |
| SPACING | 1 (TRIMMING) |
| JAPANESE HIRAGANA/KATAKANA CHARACTERS (REQUIRING NO UNDERLINING) | 1 (TRIMMING) |

For example, the following pattern comprises the combination of two underlined alphabetical words and the spacing interposed between the words. In this combined pattern, crossover thread is designated by an underline.

B_R_O_T_H_E_RS_E_W_I_N_G

When the operator registers the pattern data of the above pattern with the pattern input unit 97, the trimming flag is included in the pattern data. Where the trimming flag is one, the crossover thread is automatically trimmed. When the trimming flag is zero, the crossover thread is not trimmed.

The present invention is not limited to the embodiment described above but includes all embodiments and modifications within the scope and spirit of the invention.

What is claimed is:

1. A pattern sewing machine comprising:

(a) a needle bar carrying a needle at a lower end and being moved vertically by an arm shaft driven by a sewing machine motor;

(b) a memory means storing pattern data indicative of a pattern;

(c) a phase detection means for detecting a rotary phase of the arm shaft and for sending out a timing signal indicative of lowering of the needle bar;

(d) a thread trimming means for trimming a needle thread and a bobbin thread after stitches are formed on a fabric according to a relative movement of the needle and the fabric;

(e) a trimming designation means for specifying a cut portion of a crossover thread between the respective pattern and a next pattern to be formed according to the pattern data stored in the memory means;

(f) a trimming memory means for storing a trimming signal indicative of the cut portion of the crossover thread specified by the trimming designation means; and (g) a trimmer drive means for driving the thread trimming means in response to both the trimming signal and the timing signal.

2. The pattern sewing machine according to claim 1 wherein the timing signal indicates the lowering of the needle bar, and the needle thread and the bobbin thread come between a movable knife and a fixed knife of the thread trimming means.

3. The pattern sewing machine according to claim 1 wherein the thread trimming means includes:

(d1) means for cutting the needle thread and the bobbin thread between the movable knife and the fixed knife when the trimmer drive means drives the thread trimming means.

4. The pattern sewing machine according to claim 1 wherein the thread trimming means includes:

(d2) means for cutting the needle thread and the bobbin thread between the movable knife and the fixed knife of the thread trimming means at the beginning of the next pattern when a needle lowers into the beginning of the next pattern and the trimmer drive means receives the thread trimming signal from the thread trimming memory and the timing signal from the phase detecting means.

5. The pattern sewing machine according to claim 1, wherein the thread trimming designation means includes:

(e1) means for specifying the cut portion of the crossover thread formed between the previously formed pattern and the next pattern to be formed, before the next pattern is formed according to the pattern data stored in the memory means.

6. The pattern sewing machine according to claim 1 wherein the thread trimming designation means includes:

(e2) means for specifying after a series of patterns is formed, that the portion of the crossover thread to be cut is formed between the end of the pattern and the beginning of the next pattern.

7. The pattern sewing machine according to claim 1 wherein the thread trimming designation means includes:

(e3) display means for displaying a symbol of scissors on a liquid crystal display when the thread trimming designation means specifies the cut portion of the crossover thread.

8. The pattern sewing machine according to claim 7 wherein the display means displays the symbol by blinking so that an operator can visually confirm the cut portion of the crossover thread.

9. The pattern sewing machine according to claim 1 wherein the trimming memory means includes:

(f1) a random access memory for temporarily storing the trimming signal.

10. The pattern sewing machine according to claim 1 wherein the trimmer drive means includes:

(g1) means for receiving the trimming signal from the trimmer drive means when the needle lowers into an end of the pattern.

11. The pattern sewing machine according to claim 1 wherein the trimmer drive means includes:

(g2) means for sending a drive signal to the thread trimming means on condition that the trimmer drive means receives simultaneously the thread trimming signal from the thread trimming memory and the timing signal sent from the phase detecting means.

12. A pattern sewing machine comprising:

(a) a needle bar carrying a needle at a lower end and being moved vertically by an arm shaft driven by a sewing machine motor;

(b) a memory means storing pattern data indicative of a pattern;

(c) a phase detection means for detecting a rotary phase of the arm shaft and for sending out a timing signal indicative of lowering of the needle bar;

(d) a thread trimming means for trimming a needle thread and a bobbin thread after stitches are formed on fabric according to a relative movement of the needle and the fabric;

(e) a trimming memory means for storing a trimming signal indicative of a cut portion of the crossover thread in a trimming table in association with the pattern data indicative of the pattern in the memory; and (f) a trimmer drive means for driving the thread trimming means in response to both the trimming signal and the timing signal.

13. The pattern sewing machine according to claim 12, wherein the trimming memory means includes:

means for automatically determining the cut portion according to a trimming flag associated with the pattern data in the trimming table.

14. The pattern sewing machine according to claim 13, wherein the trimming memory means includes:

means for automatically determining the cut portion according to the trimming flag adjacent the corresponding pattern data in the trimming table.

15. The pattern sewing machine according to claim 14, wherein pattern data of an underlined alphabetical word is associated with the trimming signal indicating no trimming, and pattern data of a spacing and a Japanese hiragana/katakana character is associated with the trimming signal indicating trimming in the trimming table.

16. A pattern sewing machine comprising:

(a) a needle bar carrying a needle at a lower end and being moved vertically by an arm shaft driven by a sewing machine motor;

(b) a memory for storing pattern data indicative of a respective pattern;

(c) a phase detector for detecting a rotary phase of the arm shaft and for sending out a timing signal indicative of lowering of the needle bar;

(d) a thread trimmer for trimming a needle thread and a bobbin thread after stitches are formed on fabric according to a relative movement of the needle and the fabric;

(e) a trimming designator for specifying a portion of a crossover thread to be cut off between the respective pattern and a next pattern to be formed according to the pattern data stored in the memory;

(f) a trimming memory for storing the portion to be cut off on the crossover thread specified by the trimming designation means;

(g) an AND circuit connected to the trimming designator and the phase detector for receiving the trimming signal and the timing signal and for outputting an AND signal; and (h) a driver connected to the AND circuit for receiving the AND signal for driving the thread trimmer to cut the needle thread and the bobbin thread.

* * * * *